US008274352B2

(12) United States Patent
Wei et al.

(10) Patent No.: US 8,274,352 B2
(45) Date of Patent: Sep. 25, 2012

(54) INDUCTOR DEVICES

(75) Inventors: Chang-Lin Wei, Hsinchu (TW); Kuo-Chiang Chin, Jhonghe (TW); Cheng-Hua Tsai, Yonghe (TW); Chin-Sun Shyu, Hsinchu (TW); Chang-Sheng Chen, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 13/009,432

(22) Filed: Jan. 19, 2011

(65) Prior Publication Data

US 2011/0169597 A1 Jul. 14, 2011

Related U.S. Application Data

(62) Division of application No. 11/852,094, filed on Sep. 7, 2007, now abandoned.

(60) Provisional application No. 60/900,199, filed on Feb. 7, 2007.

(51) Int. Cl.
*H01F 17/06* (2006.01)

(52) U.S. Cl. ..... 336/178

(58) Field of Classification Search ..... 336/65, 336/178, 200, 206–208, 232
See application file for complete search history.

(56) References Cited

U.S. PATENT DOCUMENTS

| | | | | |
|---|---|---|---|---|
| 5,373,112 | A | 12/1994 | Kamimura et al. | |
| 5,396,101 | A | 3/1995 | Shiga | |
| 5,532,667 | A | 7/1996 | Haertling et al. | |
| 5,852,866 | A | 12/1998 | Kuettner et al. | |
| 6,175,727 | B1 | 1/2001 | Mostov et al. | |
| 6,242,791 | B1 | 6/2001 | Jou | |
| 6,448,873 | B1 | 9/2002 | Mostov et al. | |
| 6,800,936 | B2 | 10/2004 | Kosemura et al. | |
| 6,867,678 | B2 | 3/2005 | Yang | |
| 7,053,165 | B2 | 5/2006 | Furumiya et al. | |
| 7,212,094 | B2 | 5/2007 | Matsutani et al. | |
| 7,262,680 | B2 | 8/2007 | Wang | |
| 7,414,506 | B2 | 8/2008 | Furumiya et al. | |
| 7,504,922 | B2 * | 3/2009 | Lee | 336/200 |
| 2002/0050626 | A1 | 5/2002 | Onuma et al. | |
| 2003/0095026 | A1 | 5/2003 | Kawanobe | |

FOREIGN PATENT DOCUMENTS

CN 1539150 A 10/2004

(Continued)

OTHER PUBLICATIONS

Office Action dated May 16, 2011 from corresponding Japanese Application No. 2007-328412.

(Continued)

*Primary Examiner* — Tuyen Nguyen
(74) *Attorney, Agent, or Firm* — Alston & Bird LLP

(57) ABSTRACT

An inductor device comprising a first conductive pattern on a first layer of a substrate, a second conductive pattern on a second layer of the substrate, and a first region between the first layer and the second layer through which at least one hole is coupled between the first dielectric layer and the second dielectric layer, wherein a magnetic field induced by at least one of the first conductive pattern or the second conductive pattern at the first region is more intensive than that induced by at least one of the first conductive pattern or the second conductive pattern at a second region between the first conductive layer and the second conductive layer.

12 Claims, 16 Drawing Sheets

FOREIGN PATENT DOCUMENTS

| | | |
|---|---|---|
| JP | 08-022694 | 1/1996 |
| JP | 08-083717 | 3/1996 |
| JP | 8-222694 A | 8/1996 |
| JP | 11-243015 | 9/1999 |
| JP | 2001-223331 | 8/2001 |
| JP | 2002-043520 | 2/2002 |
| JP | 2002-198490 | 7/2002 |
| JP | 2004-356119 | 12/2004 |
| JP | 2005-223042 | 8/2005 |
| JP | 2006-351687 | 12/2006 |
| WO | WO 97/14170 | 4/1997 |

OTHER PUBLICATIONS

Office Action dated Apr. 20, 2011 of corresponding Chinese Patent Application No. 200710199836.9 (translation of summary attached).

Office Action dated Oct. 18, 2010 of corresponding Application No. 200710199836.9.

Office Action dated Dec. 18, 2009 of corresponding Chinese Application No. 200710199836.9.

Office Action dated Jun. 1, 2010 of corresponding Japanese Application No. 2007-328412.

Office Action dated Jun. 23, 2008 of related U.S. Appl. No. 11/852,094, filed Sep. 7, 2007.

Office Action dated Oct. 16, 2008 of related U.S. Appl. No. 11/852,094, filed Sep. 7, 2007.

Office Action dated Jun. 1, 2009 of related U.S. Appl. No. 11/852,094, filed Sep. 7, 2007.

Office Action dated Dec. 30, 2009 of related U.S. Appl. No. 11/852,094, filed Sep. 7, 2007.

Office Action dated Oct. 10, 2010 of related U.S. Appl. No. 11/852,094, filed Sep. 7, 2007.

* cited by examiner

INDUCTOR DEVICES

CROSS-REFERENCE TO RELATED APPLICATIONS

This application is a division of U.S. patent application Ser. No. 11/852,094 filed Sep. 7, 2007 now abandoned and this application claims the benefit of U.S. Provisional Application No. 60/900,199, filed Feb. 7, 2007.

BACKGROUND

The disclosure generally relates to inductor devices and, more particularly, to embedded inductor structures with an improved quality factor.

Inductors have been widely used in circuits such as resonators, filters, and impedance transformers. Conventional inductors are mounted on circuit boards utilizing the surface mounting technique (SMT) or other complicated processes, and they may occupy an undesirably large area or exhibit an undesirable height on the circuit boards. To reduce the size, embedded inductors have been developed. FIG. 1A and FIG. 1B are diagrams of an embedded spiral-type inductor in the prior art. FIG. 1A is a top plan view of a spiral-type inductor 10 in the prior art. Referring to FIG. 1A, the spiral-type inductor 10 is formed on a multilayered substrate 11 and includes a conductive coil 13 extending from a port 1A to a port 2A through a conductive path 14 formed in a different layer of the multilayered substrate 11. FIG. 1B is a cross-sectional view of the spiral-type inductor 10 along a line A1 shown in FIG. 1A. As illustrated in FIG. 1B, the conductive coil 13 of the spiral-type inductor 10 is formed on a layer 111 of the multilayered substrate 11, and the conductive path 14 is formed on a layer 112, which is electrically connected to the layer 111 through conductive vial V11 and V12.

The quality factor (Q-factor) of an inductor incorporated into a communication system may largely determine the communication quality. For example, an inductor with a low Q-factor may incur significant insertion loss in the pass band of a filter and may increase the bandwidth of the filter, which renders the system more liable to noise. As another example, an inductor with a low Q-factor may incur undesirable phase noise in a resonator, which may deteriorate the quality of a communication system.

Many inductor structures have been proposed to provide an improved Q-factor. Examples of the inductor structures can be found in the prior art techniques as follows. U.S. Pat. No. 5,373,112 to Kamimura, entitled "Multilayered wiring board having printed inductor," disclosed a multilayered wiring board having a printed inductor which is formed on a grounding layer or electric power supply layer through a dielectric layer inserted between them, wherein a removed portion is formed only in the grounding layer or electric power supply layer which is positioned right under the printed inductor and in the neighboring area and no removed portion is formed in the dielectric layer. U.S. Pat. No. 6,175,727 to Mostov and Letzion, entitled "Suspended printed inductor and LC-type filter constructed therefrom,", and U.S. Pat. No. 6,448,873 to Mostov and Letzion, entitled "LC filter with suspended printed inductor and compensating interdigital capacitor," introduced suspended-structured printed inductors in order to increase the Q-factor of an inductor. U.S. Pat. No. 6,800,936 to Kosemura et al., entitled "High frequency module device," disclosed a device where metal conductive portions under an inductor formed on a built-up multilayered substrate are removed by etching to reduce parasitic effect in order to increase the Q-factor of the inductor. However, the above-mentioned prior art structured or processes may be complicated in certain applications. Therefore, there is a need for an inductor that has an improved Q-factor under certain configurations and a structure that is easy to fabricate with semiconductor processing or PCB processing.

SUMMARY

Examples of the disclosure may include an inductor device comprising a substrate having at least one substrate layer, a conductive coil formed on one of the at least one substrate layer, the conductive coil having two terminals and including a plurality of connected spirals between the two terminals, and an area on a surface of the one substrate layer at which a hole is provided through the surface, the area being surrounded by at least one of the connected spirals of the conductive coil.

Some examples of the disclosure may also include an inductor device comprising a substrate having at least one substrate layer, a conductive path extending over the substrate layer and winding around a surface of the substrate layer, the conductive path having two terminals and comprising a plurality of conductive windings, and an area on a surface of the substrate layer at which at least one hole is provided through the surface, the area being substantially surrounded by at least one of the plurality of conductive windings.

Examples of the disclosure may further include an inductor device comprising a first conductive pattern on a first layer of a substrate, a second conductive pattern on a second layer of the substrate, and a first region between the first layer and the second layer through which at least one hole is coupled between the first dielectric layer and the second dielectric layer, wherein a magnetic field induced by at least one of the first conductive pattern or the second conductive pattern at the first region is more intensive than that induced by at least one of the first conductive pattern or the second conductive pattern at a second region between the first conductive layer and the second conductive layer.

Examples of the disclosure may additionally include an inductor device comprising a first conductive coil, a second conductive coil, and a first region through which at least one hole is provided, wherein a magnetic field induced by at least one of the first conductive coil or the second conductive coil at the first region is more intensive than that induced by at least one of the first conductive coil or the second conductive coil at a second region.

Additional features and advantages of the disclosure will be set forth in part in the description which follows, and in part will be obvious from the description, or may be learned by practice of the disclosure. The features and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings examples which are presently preferred. It should be understood, however, that the disclosure is not limited to the precise arrangements and instrumentalities shown.

In the drawings.

DETAILED DESCRIPTION OF THE DISCLOSURE

Reference will now be made in detail to the present examples of the disclosure illustrated in the accompanying drawings. Wherever possible, the same reference numbers will be used throughout the drawings to refer to the same or like portions.

Figure 1A:
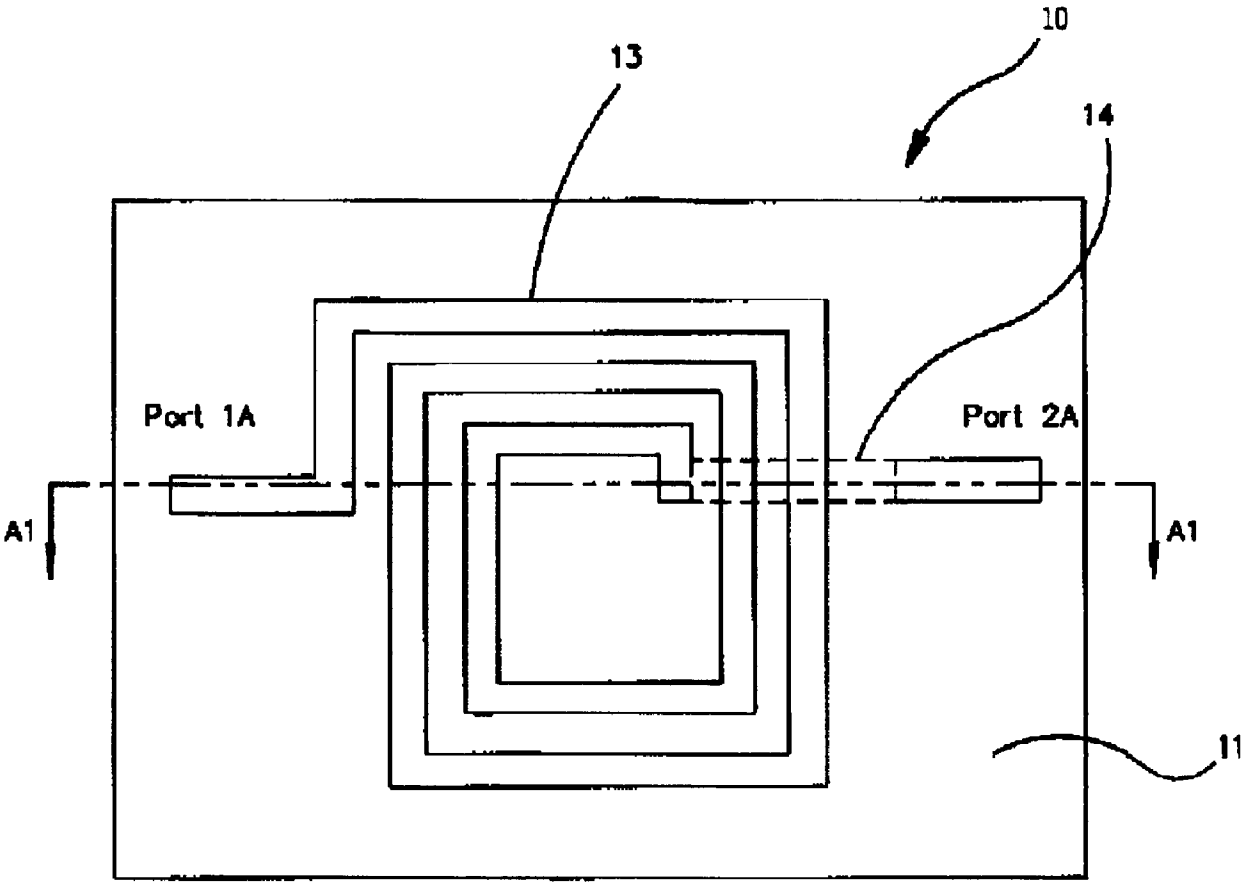
FIG. 1A(Prior Art)
FIG. 1A is a top plan view of a spiral-type inductor in the prior art.
Figure 1B:
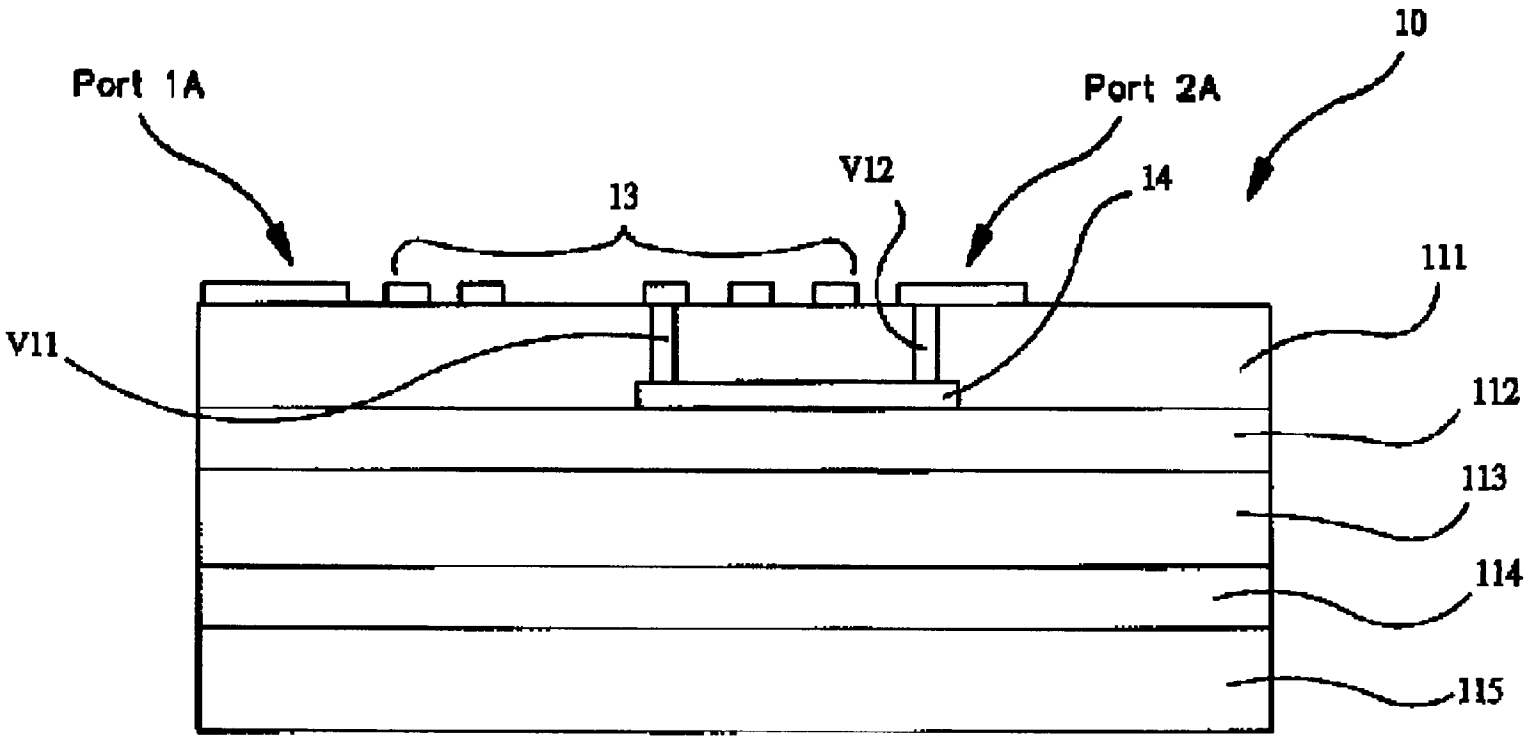
FIG. 1B(Prior Art)
FIG. 1B is a cross-sectional view of the spiral-type inductor along a line A1 shown in FIG. 1A.
Figure 2A:
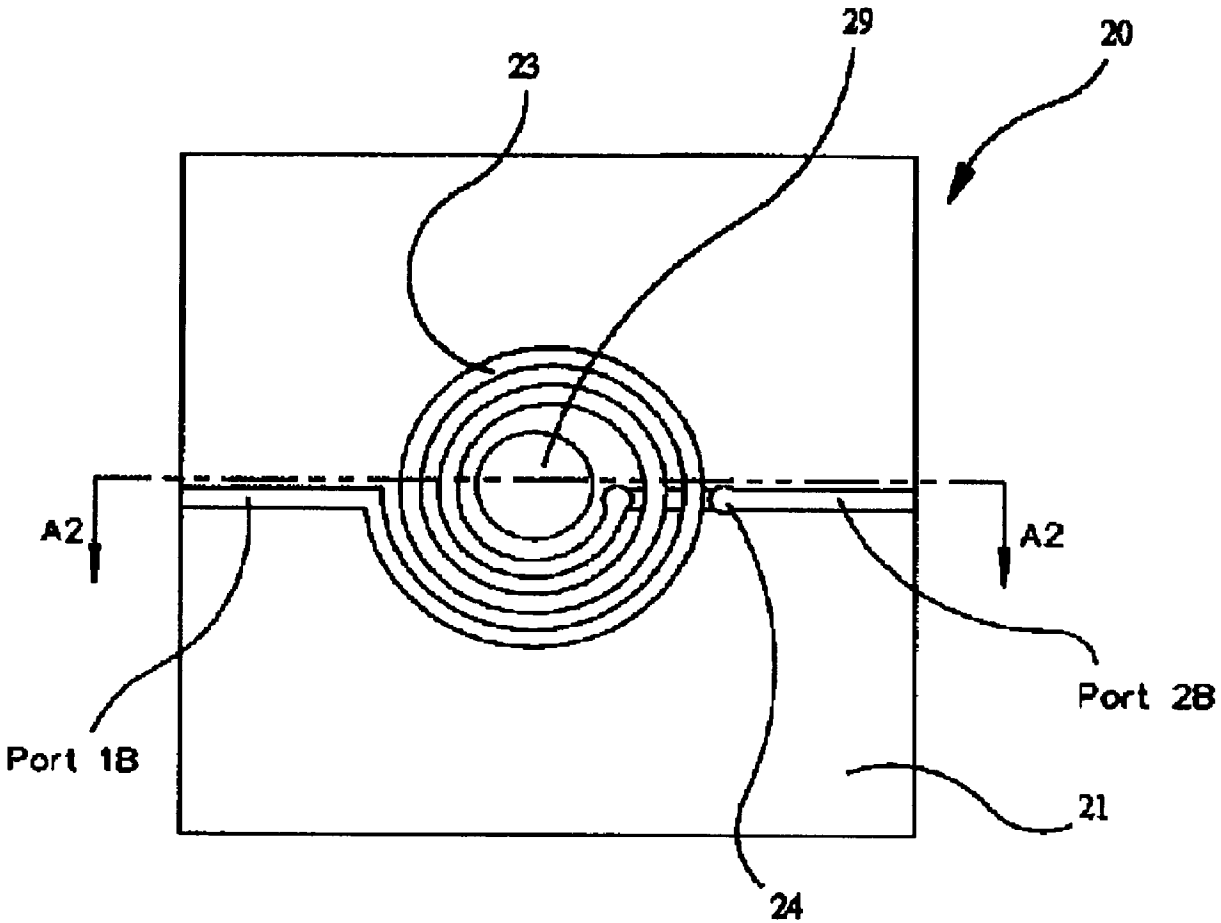
FIG. 2A is a top plan view of a spiral-type inductor according to an example of the disclosure.
Figure 2B:
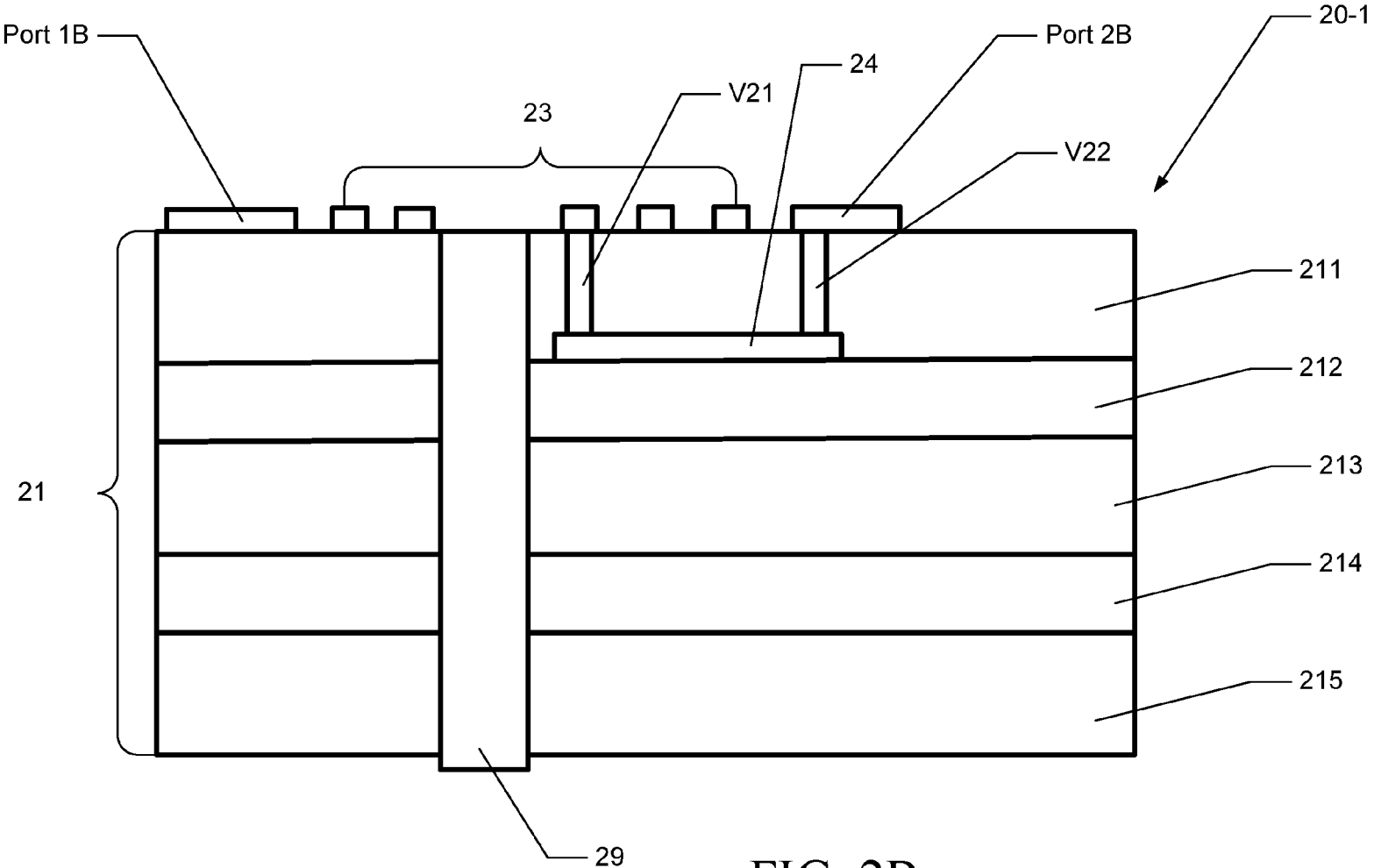
FIG. 2B is a cross-sectional view of a spiral-type inductor according to an example of the disclosure.
Figure 2C:
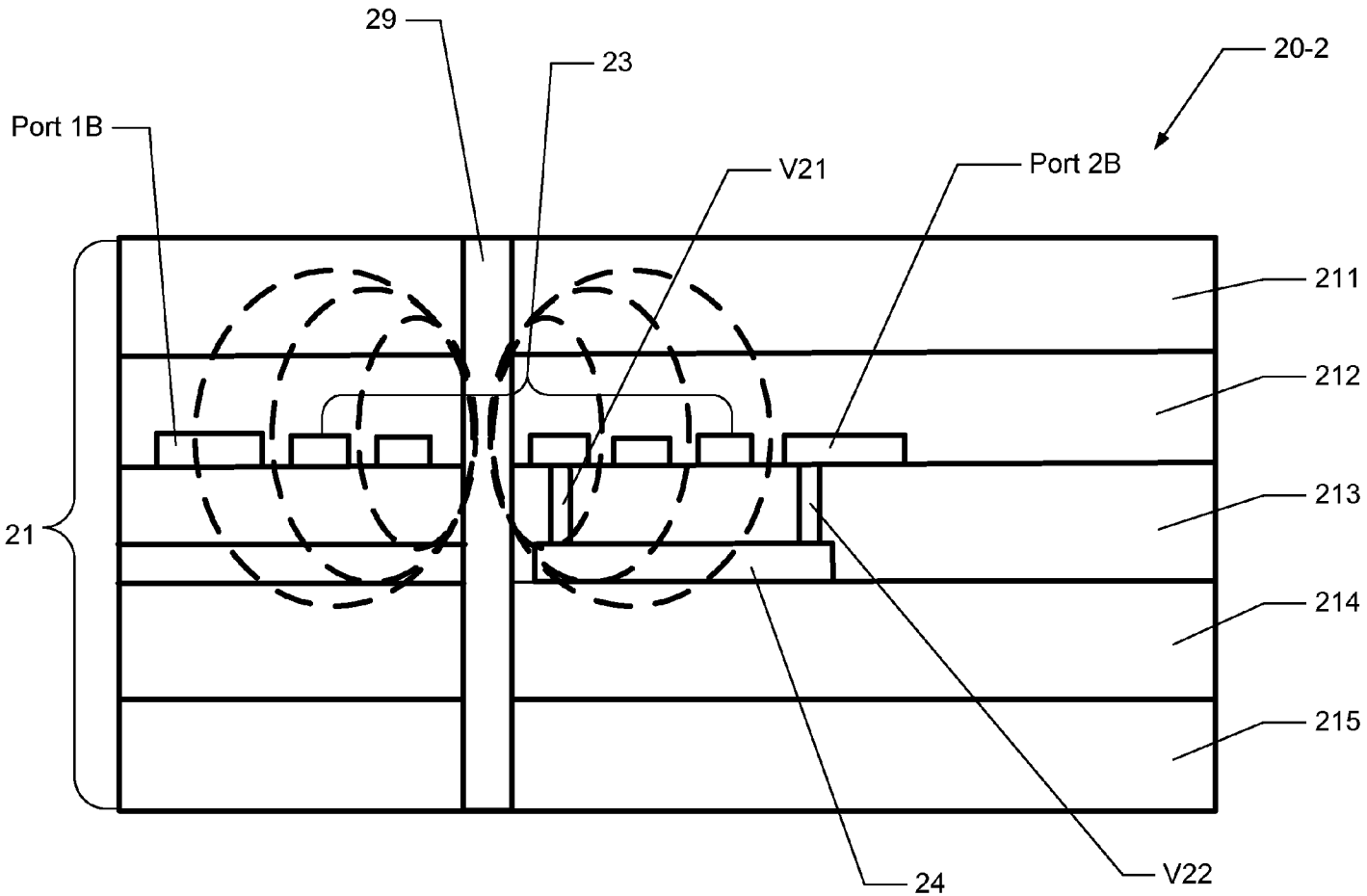
FIG. 2C is a cross-sectional view of a spiral-type inductor according to another example of the disclosure.

FIG. 2A, FIG. 2B and FIG. 2C are diagrams of an embedded spiral-type inductor according to an example of the disclosure. FIG. 2A is a top plan view of a spiral-type inductor 20 according to an example of the disclosure. Referring to FIG. 2A, the spiral-type inductor 20, formed on a multilayered substrate 21, may include a conductive coil 23 extending from a port 1B to a port 2B through a conductive path 24. In one example, the conductive coil 23 may include a plurality of connected spirals between the ports 1B and 2B. In the present example, the conductive coil 23 and the ports 1B and 2B may be formed on a top surface of the multilayered substrate 21. In other examples, such as an example illustrated in FIG. 2C, the conductive coil 23 and the ports 1B and 2B may be formed in an intermediate layer of the multilayered substrate 21. The conductive path 24 of the spiral-type inductor 20 may be formed below the top surface in a different layer of the multilayered substrate 21. The conductive coil 23 may encircle a hole 29 at an area on the multilayered substrate 21. The hole 29 may include one of a via hole, a recessed hole and a through hole. In one example, the hole 29 may be provided at an area on or in a zone within the multi-layered substrate 21 where a magnetic field or force induced by the conductive coil 23 may be relatively intensive. Skilled persons in the art will understand that the pattern of a conductive path may determine an area on a layer where a hole may be located. As an example of the coil structure 23, the center area or the eye of the coil 23 may exhibit a magnetic field more intensive than those at other areas on the layer. In one example, the connected spirals may have different shapes, including a shape of at least one of a substantially rectangular, square, circular and elliptical shape.

FIG. 2B is a cross-sectional view of a spiral-type inductor 20-1 according to an example of the disclosure. Referring to FIG. 2B, the spiral-type inductor 20-1 may be similar to the spiral-type inductor 20 taken along a line A2 shown in FIG. 2A. As illustrated in FIG. 2B, the conductive coil 23 of the spiral-type inductor 20-1 may be formed on a layer 211 of the multilayered substrate 21, and the conductive path 24 may be formed on a layer 212. The conductive path 24 may be electrically connected to the coil 23 through vias V21 and V22. The hole 29 may penetrate the multilayered substrate 21 at an area where the magnetic force induced by the conductive coil 23 may be relatively intensive.

FIG. 2C is a cross-sectional view of a spiral-type inductor 20-2 according to another example of the disclosure. Referring to FIG. 2C, the spiral-type inductor 20-2 may be similar to the spiral-type inductor 20-1 illustrated in FIG. 2B except that the conductive coil 23 and the conductive path 24 are formed on intermediate layers 213 and 214, respectively, of the multilayered substrate 21. The dotted circles represent magnetic lines of a magnetic field induced by the conductive coil 23 of the spiral-type inductor 20-2. The conductive coil 23 may have a circular shape as illustrated in FIG. 2C, or one of a rectangular, polygonal and elliptical shape in other examples. In a simulation experiment, a hole into or within a substrate may help improve the quality factor (Q-factor) of a spiral-type inductor as compared to a spiral-type inductor without such a hole.

Referring again to FIGS. 2A, 2B, and 2C, the inductors 20, 20-1 and 20-2 may include a printed inductor. The multilayered substrate 21 may include one of a printed circuit board (PCB), a ceramic substrate and an integrated circuit substrate, which may further comprise a stack of dielectric layers. Furthermore, the multilayered substrate 21 may include materials of relatively low dielectric loss to improve robustness of the inductor. The materials, for example, may have a dielectric loss tangent less than 0.03 or even 0.01. The substrate 21 may include one of an Arlon 25 or Arlon AR600 laminate substrates, both of which may be available from Arlon Inc. (California, United States), a GML1000 substrate, which may be available from GIL Technologies (Tennessee, United States) and a Gigaver210 substrate, which may be available from Isola USA Corporation (Arizona, United States). Moreover, in an example according to the disclosure, an area where the hole 29 is provided into a layer may have a dielectric loss tangent smaller than that of other areas on the layer.

In another example, the hole 29 may be filled with a material of relatively high permeability to increase the inductance. In still another example, the sidewall surface of the hole 29 may be plated or coated with a material of relatively high permeability. In yet another example, the hole 29 may be plated or coated and then filled with a material or relatively high permeability to further increase the inductance. The materials, for example, may have a permeability larger than 1.1 and may be selected from one of iron (Fe), cobalt (Co) and nickel (Ni). In still another example, the hole 29 may be filled with copper (Cu) to improve the substrate robustness. Furthermore, the hole 29 of the spiral-type inductors 20, 20-1 and 20-2 may include a cross-sectional shape having at least one of a substantially circular, triangular, rectangular, polygonal, elliptical shape or other suitable shape.

Figure 3A:
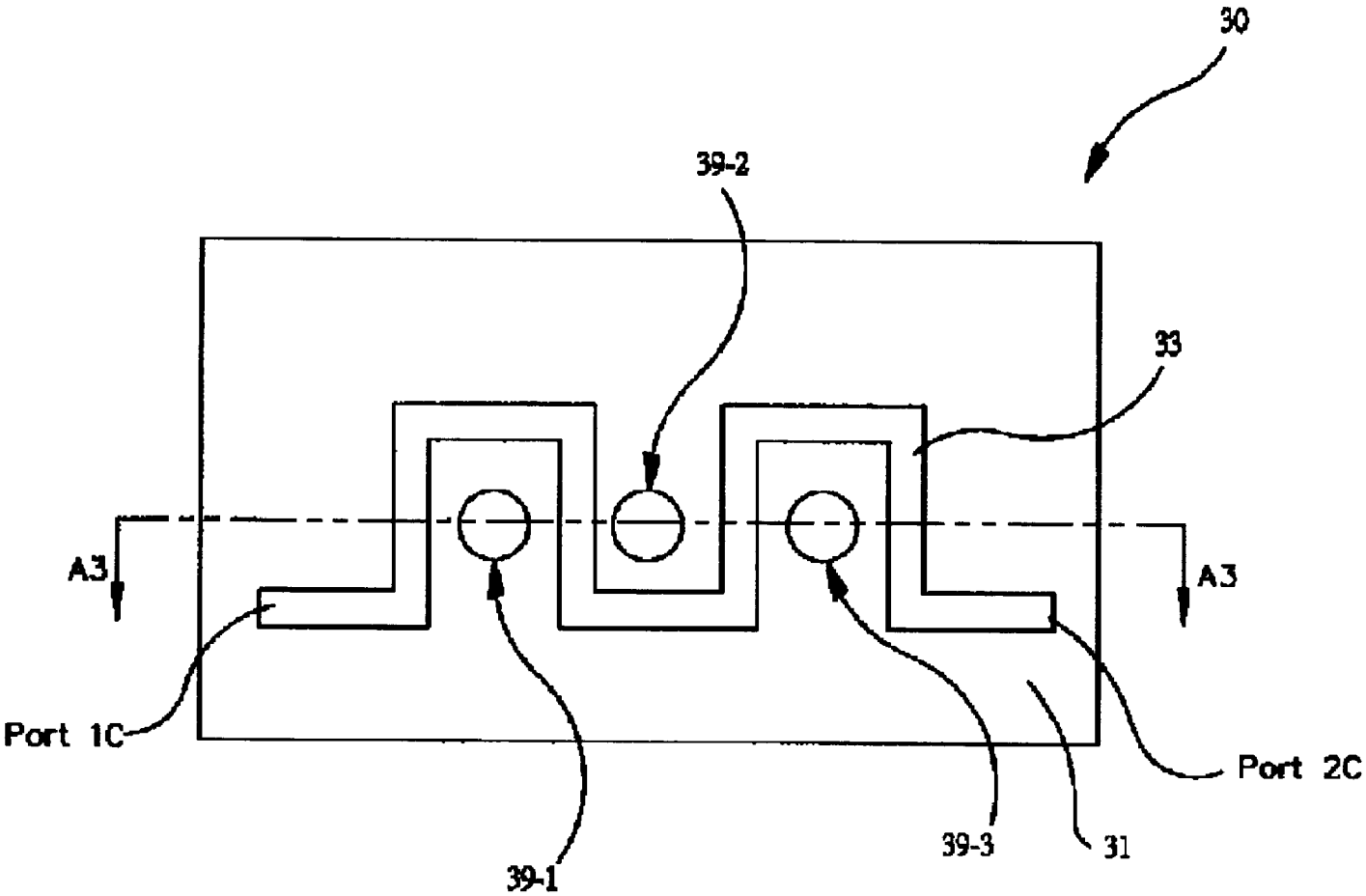
FIG. 3A is a top plan view of a meander-type inductor according to an example of the disclosure.
Figure 3B:
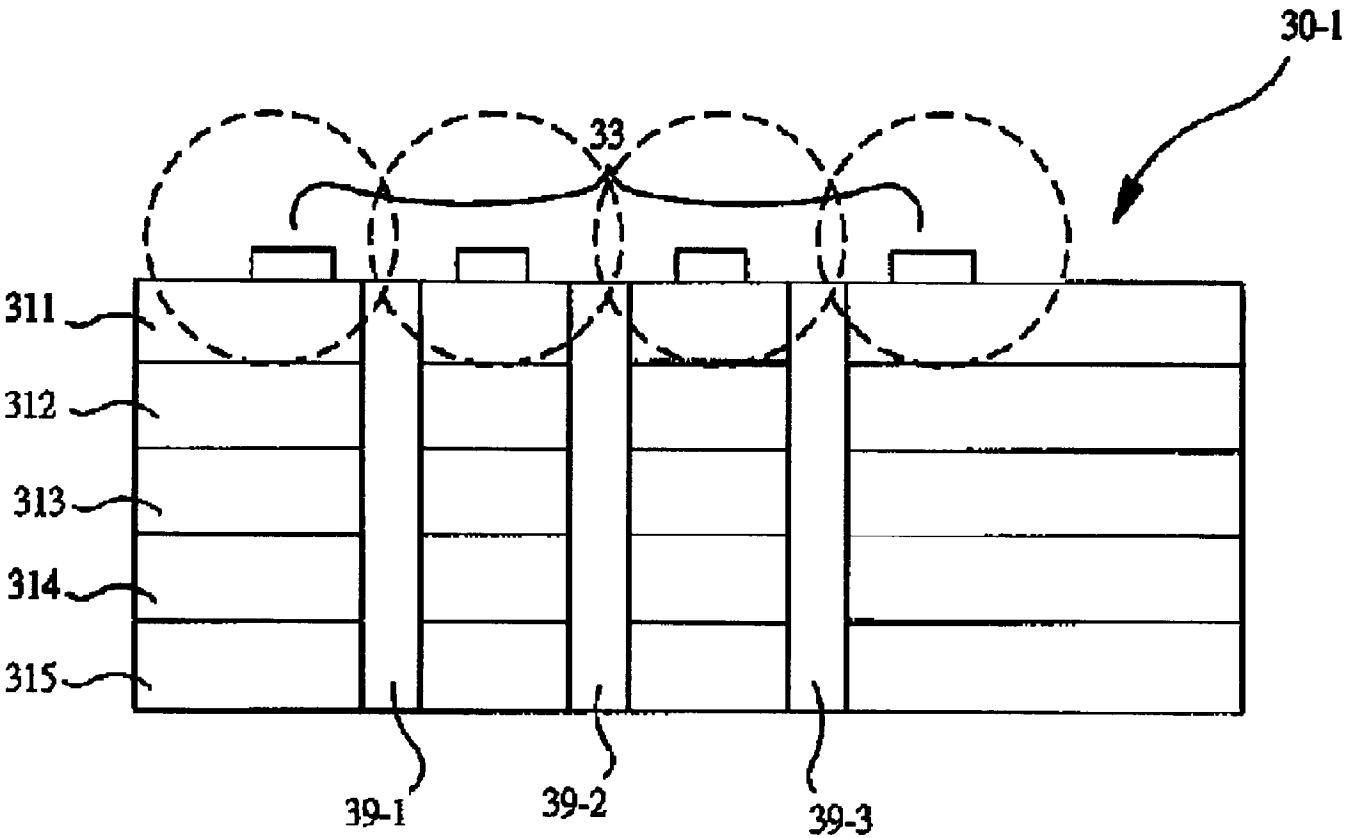
FIG. 3B is a cross-sectional view of a meander-type inductor according to an example of the disclosure.
Figure 3C:
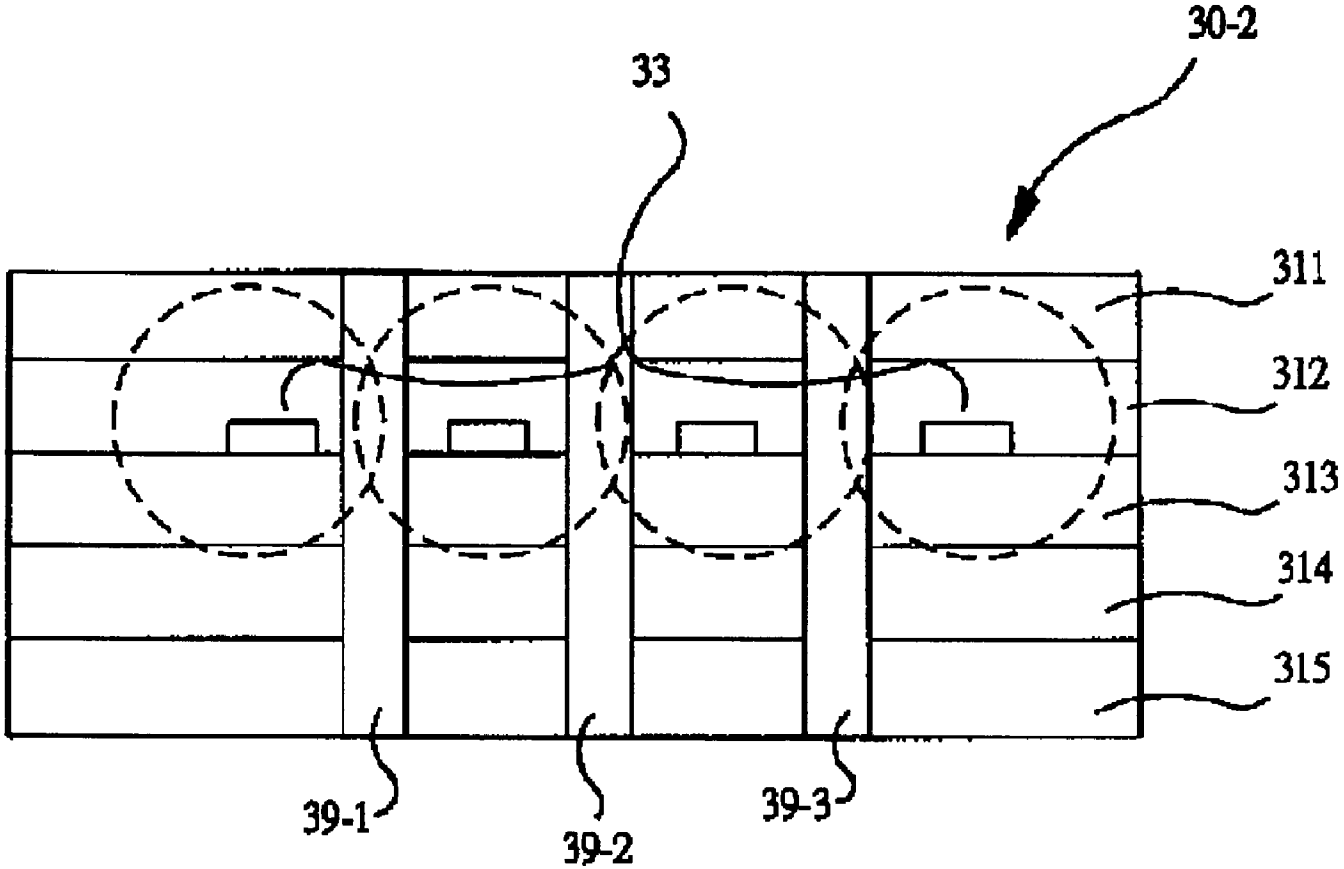
FIG. 3C is a cross-sectional view of a meander-type inductor according to another example of the disclosure.

FIGS. 3A, 3B and 3C are diagrams of an embedded meander-type inductor according to an example of the disclosure.

FIG. 3A is a top plan view of a meander-type inductor 30 according to an example of the disclosure. Referring to FIG. 3A, the meander-type inductor 30, which may be formed on a multilayered substrate 31, may include a meander-type conductive path 33 extending meanderingly or windingly from a port 1C to a port 2C in a pattern including a plurality of windings (not numbered). A plurality of holes 39-1, 39-2 and 39-3 may be provided at areas defined by the plurality of windings of the meander-type conductive path 33. Specifically, each of the holes 39-1, 39-2, and 39-3 may be provided at an area on a layer where magnetic fields may be more intensive than other areas on the layer.

FIG. 3B is a cross-sectional view of a meander-type inductor 30-1 according to an example of the disclosure. Referring to FIG. 3B, the meander-type inductor 30-1 may be similar to the meander-type inductor 30 taken along a line A3 shown in FIG. 3A. The meander-type conductive path 33 of the meander-type inductor 30-1 may be formed on a layer 311 of the multilayered substrate 31. The dotted circles represent magnetic lines of magnetic fields induced by the conductive path 33 of the meander-type inductor 30-1. The holes 39-1, 39-2 and 39-3 may penetrate the multilayered substrate 31 at areas where the magnetic fields induced by the conductive path 33 may be relatively intensive. In one example according to the disclosure, the areas where the holes 39-1, 39-2 and 39-3 are provided may have a dielectric loss tangent smaller than that of other areas on the layer.

FIG. 3C is a cross-sectional view of a meander-type inductor 30-2 according to another example of the disclosure. Referring to FIG. 3C, the meander-type inductor 30-2 may be similar to the meander-type inductor 30-1 illustrated in FIG. 3B except that the conductive path 33 of the meander-type inductor 30-2 may be embedded in an intermediate layer 312 of the multilayered substrate 31.

Figure 4A:
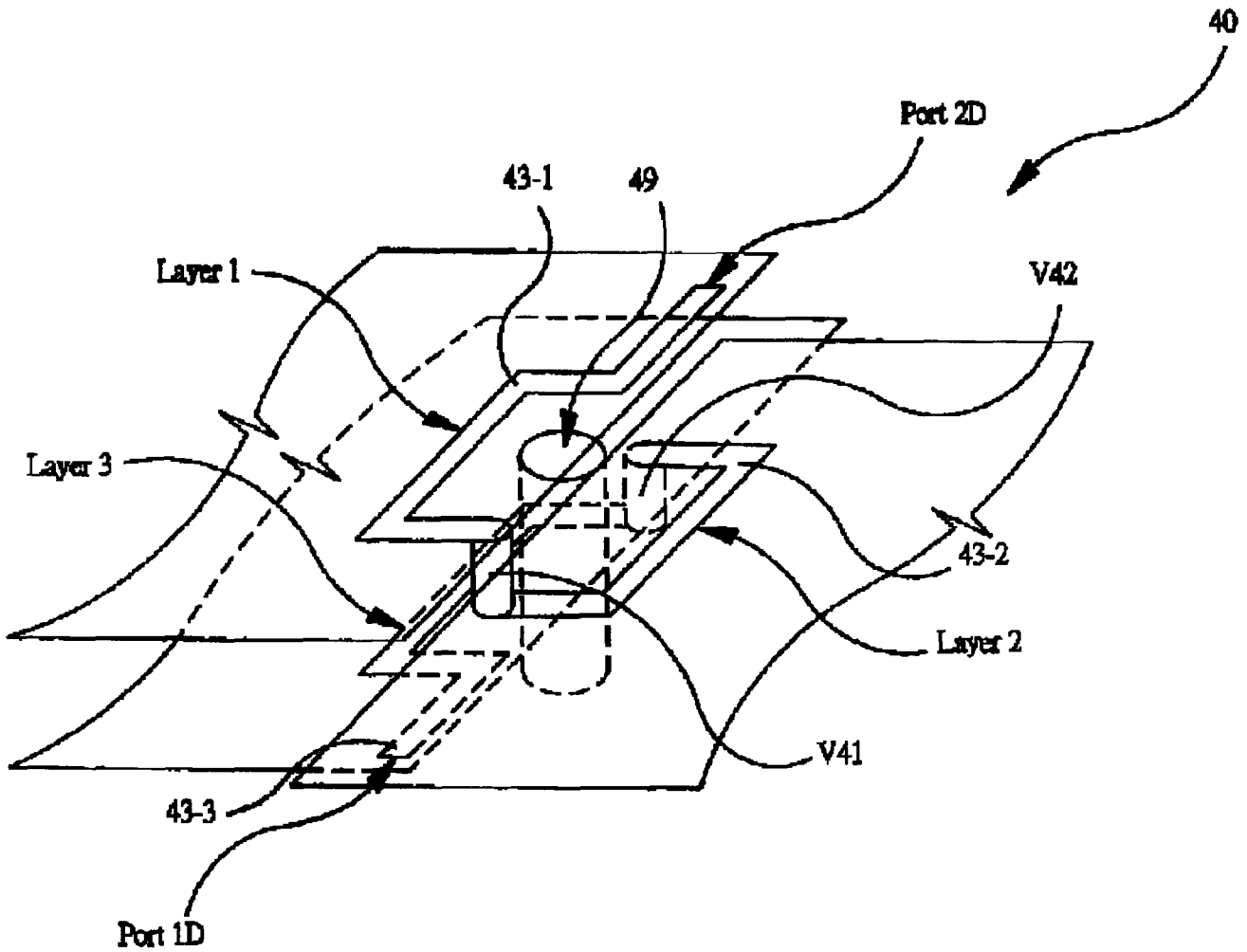
FIG. 4A is a perspective view of a helical inductor according to an example of the disclosure.
Figure 4B:
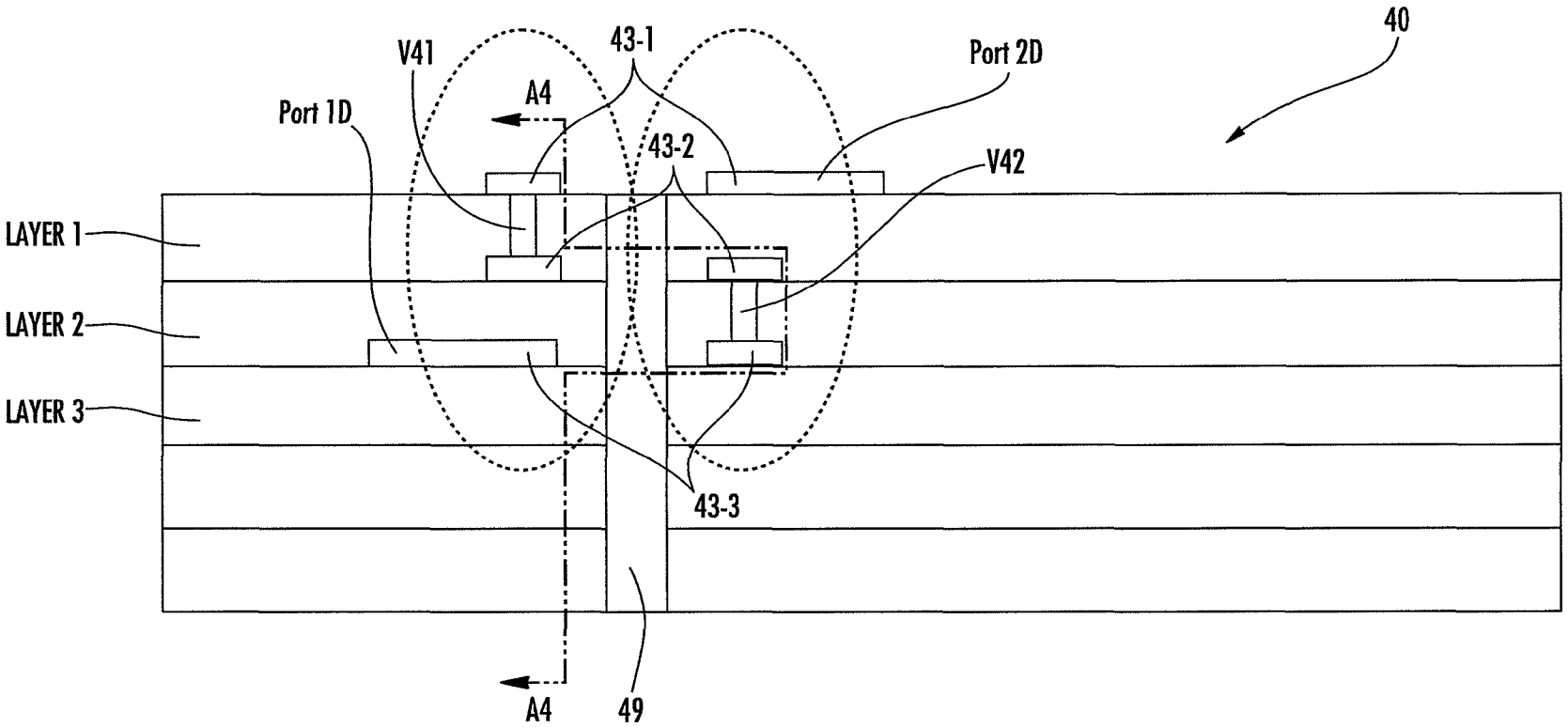
FIG. 4B is a cross-sectional view of the helical inductor illustrated in FIG. 4A.

FIGS. 4A and 4B are diagrams of a helical inductor 40 according to an example of the disclosure. FIG. 4A is a perspective view of the helical inductor 40 according to an example of the disclosure. Referring to FIG. 4A, the helical inductor 40 may be formed on a multilayered substrate (not numbered) including a first layer 1, a second layer 2 and a third layer 3. The helical inductor 40 may include a first conductive pattern 43-1 formed on the first layer 1, a second conductive pattern 43-2 formed on the second layer 2, a third conductive pattern 43-3 formed on the third layer 3, a port 1D and a port 2D. The first conductive pattern 43-1 may be electrically connected to the second conductive pattern 43-2 by a first via V41, and the second conductive pattern 43-2 may be electrically connected to the third conductive pattern 43-3 by a second via V42. A hole 49 communicating with the three layers 1, 2 and 3 may be provided in a zone defined by the three conductive patterns 43-1, 43-2 and 43-3. In one example, each of the first, second and third conductive patterns 43-1, 43-2 and 43-3 may include one of a circular, rectangular, polygonal and elliptical shape. In another example, the zone where the hole 49 is provided may have a dielectric loss tangent smaller than that of other zones in the multilayered substrate.

FIG. 4B is a cross-sectional view of the helical inductor 40 illustrated in FIG. 4A. Referring to FIG. 4B, the first conductive pattern 43-1, the second conductive pattern 43-2 and the third conductive pattern 43-3 of the helical inductor 40 may be formed on a surface each of the first layer 1, the second layer 2 and the third layer 3 of a multilayered substrate, respectively. The dotted circles represent magnetic lines of a magnetic field induced by the conductive patterns 43-1, 43-2 and 43-3 of the helical inductor 40.

Figure 5B:
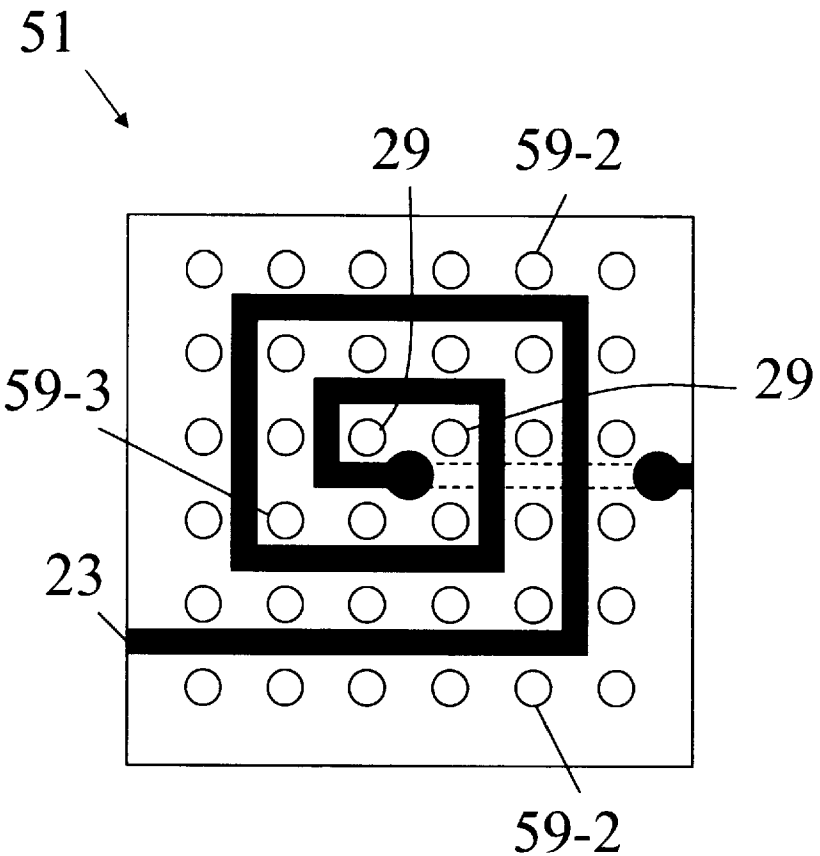
FIGS. 5A and 5B are schematic diagrams each of an inductor consistent with an example of the disclosure.
Figure 5A:
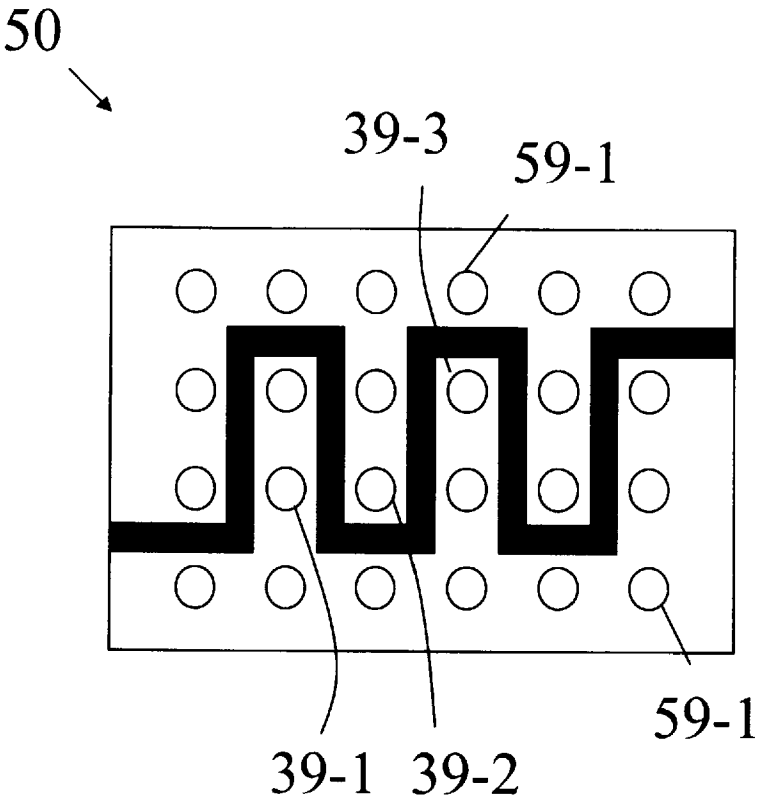

FIGS. 5A and 5B are schematic diagrams each of an inductor consistent with an example of the disclosure. FIG. 5A is a schematic diagram of a meander-type inductor 50. Referring to FIG. 5A, the meander-type inductor 50 may be similar to the meander-type inductor 30 illustrated in FIG. 3A except that at least one hole 59-1 may be provided in addition to the holes 39-1, 39-2 and 39-3, which are provided at optimal areas where magnetic fields may be relatively intensive. Each of the at least one hole 59-1 may still help improve the Q factor despite being provided at an area other than the optimal regions.

FIG. 5B is a schematic diagram of a spiral-type inductor 51. Referring to FIG. 5B, the spiral-type inductor 51 may be similar to the spiral-type inductor 20 illustrated in FIG. 2A except that at least one hole 59-2 may be provided in addition to the holes 29, which are provided at optimal areas where magnetic fields may be relatively intensive. Each of the at least one hole 59-2 may still help improve the Q factor despite being provided at an area other than the optimal areas. Furthermore, the coil 23 may include several rounds or turns, and at least one hole 59-3 may be provided at areas between the rounds or turns.

Figure 6B:
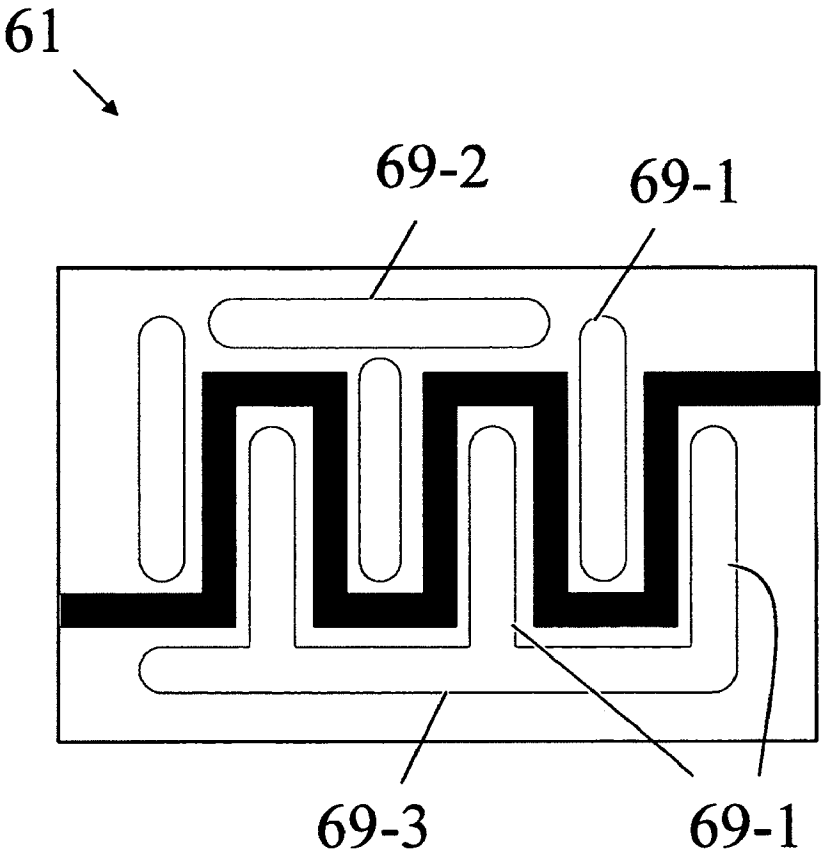
FIGS. 6A and 6B are schematic diagrams each of an inductor consistent with another example of the disclosure.
Figure 6A:
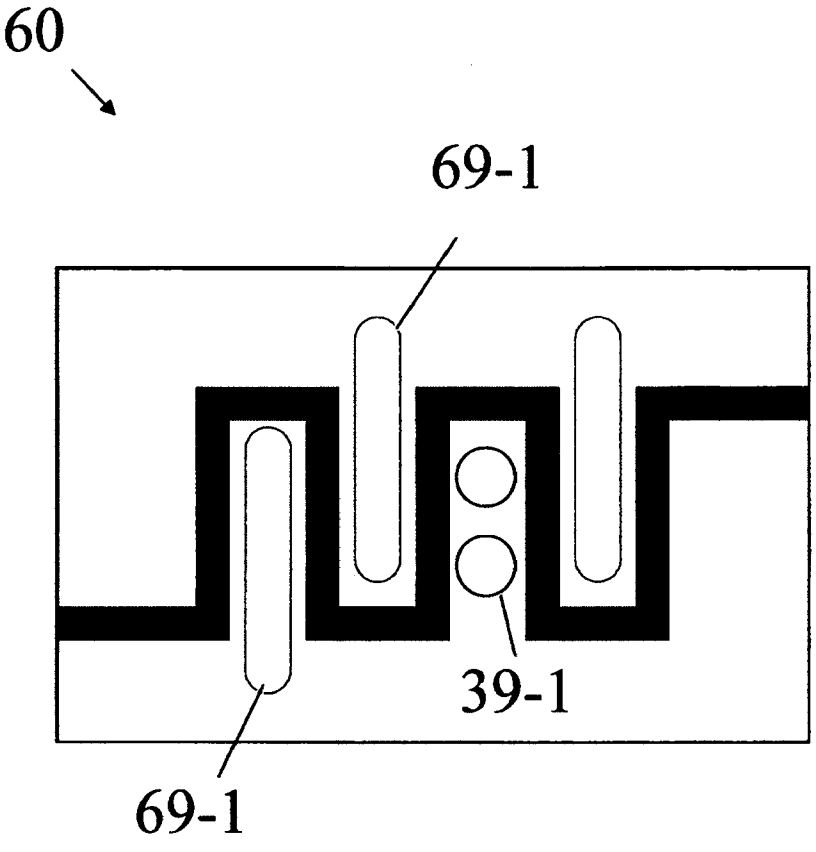

FIGS. 6A and 6B are schematic diagrams each of an inductor consistent with another example of the disclosure. FIG. 6A is a schematic diagram of a meander-type inductor 60. Referring to FIG. 6A, the meander-type inductor 60 may be similar to the meander-type inductor 30 illustrated in FIG. 3A except that at least one slot-like hole or slot hole 69-1 may be provided in addition to the holes 39-1. The at least one slot hole 69-1 may be provided at optimal areas, where magnetic fields may be relatively intensive.

FIG. 6B is a schematic diagram of a meander-type inductor 61. Referring to FIG. 6B, the meander-type inductor 61 may be similar to the meander-type inductor 60 illustrated in FIG. 6A except that at least one slot hole 69-2 may be provided in addition to the at least one slot hole 69-1. The at least one slot hole 69-2 may be provided at areas other than the optimal areas. Furthermore, in another example, at least one slot hole 69-3 may be provided, which may connect the at least one slot hole 69-1.

Figure 7B:
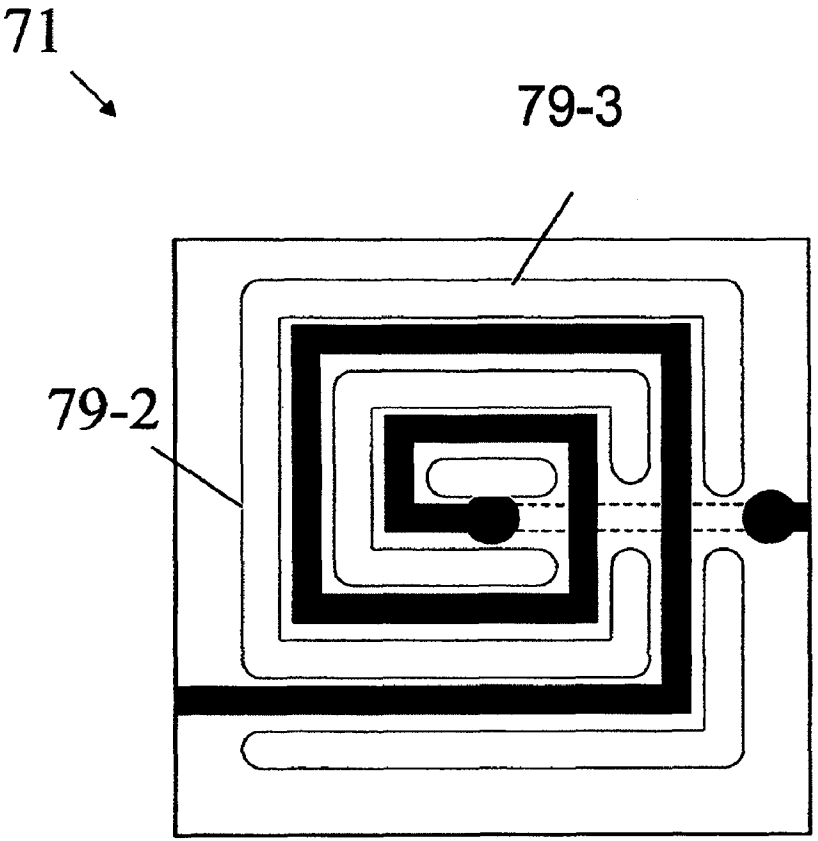
FIGS. 7A and 7B are schematic diagrams each of an inductor consistent with still another example of the disclosure.
Figure 7A:
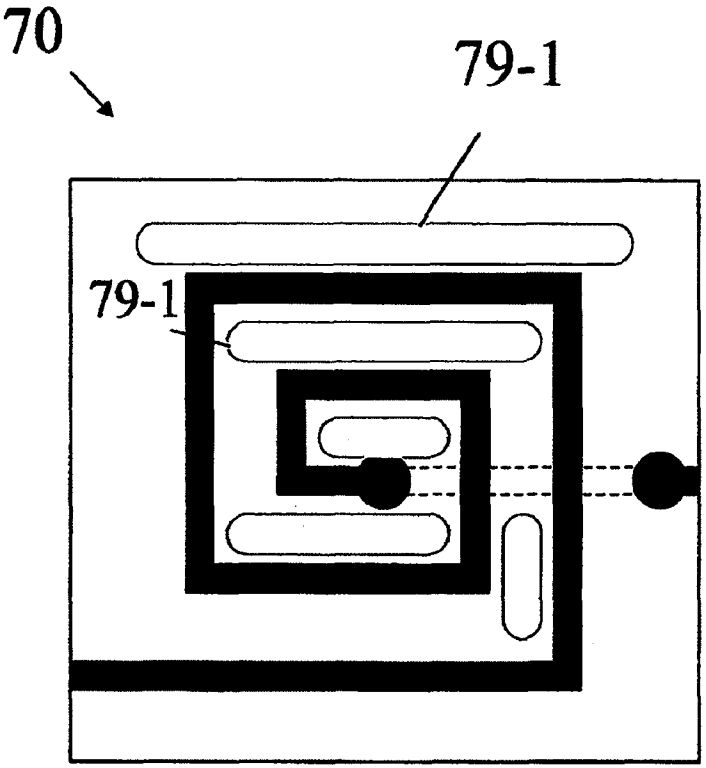

FIGS. 7A and 7B are schematic diagrams each of an inductor consistent with still another example of the disclosure. FIG. 7A is a schematic diagram of a spiral-type inductor 70. Referring to FIG. 7A, the spiral-type inductor 70 may be similar to the spiral-type inductor 20 illustrated in FIG. 2A except at least one slot hole 79-1 may be provided at an optimal area where an induced magnetic field may be relatively intensive.

FIG. 7B is a schematic diagram of a spiral-type inductor 71. Referring to FIG. 7B, the spiral-type inductor 71 may be similar to the spiral-type inductor 70 illustrated in FIG. 7A except at least one slot hole 79-2 may be provided, which may connect to the at least one hole 79-1 to form a coil structure.

Figure 8A:
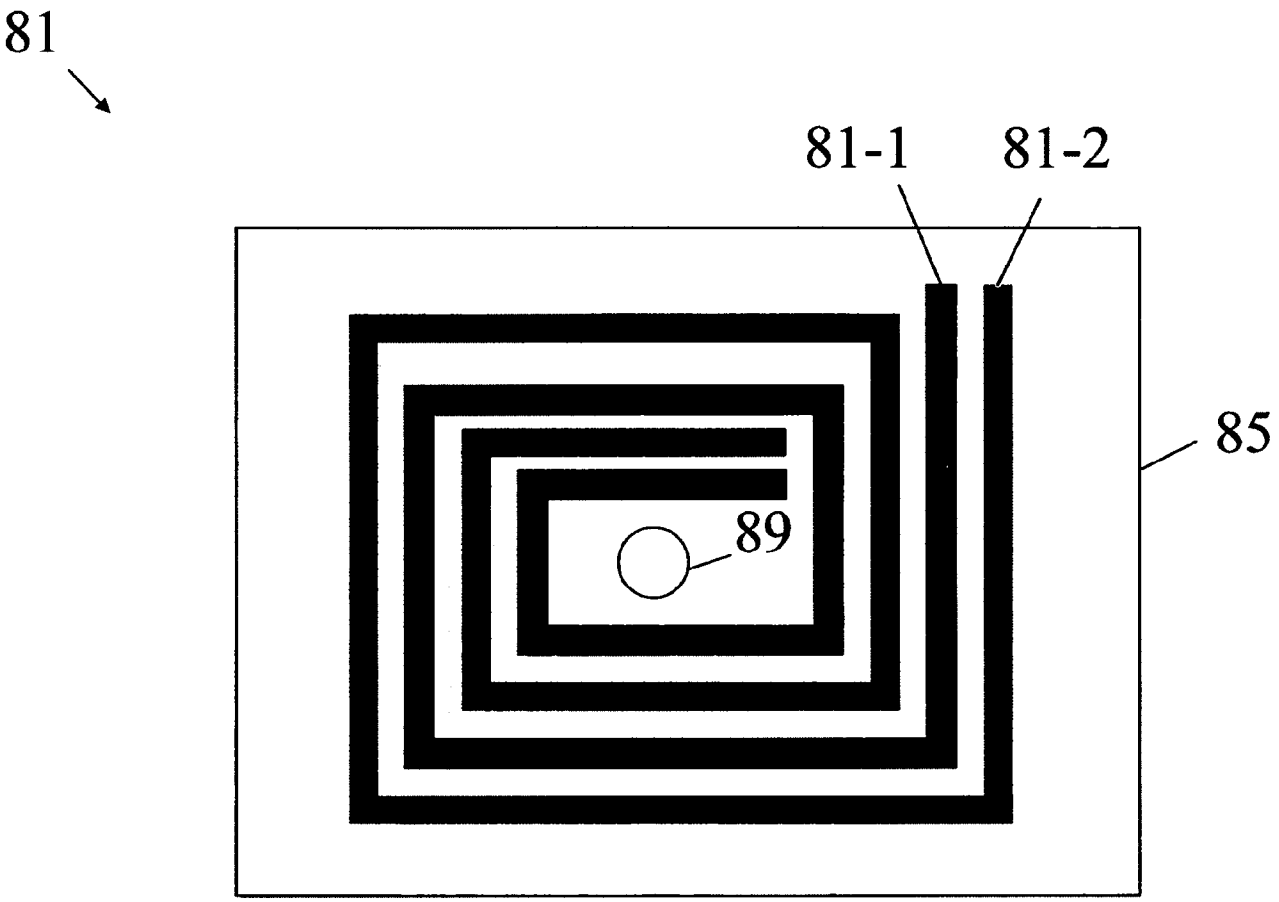
FIGS. 8A, 8B and 8C are schematic diagrams each of an inductor consistent with yet another example of the disclosure.
Figure 8B:
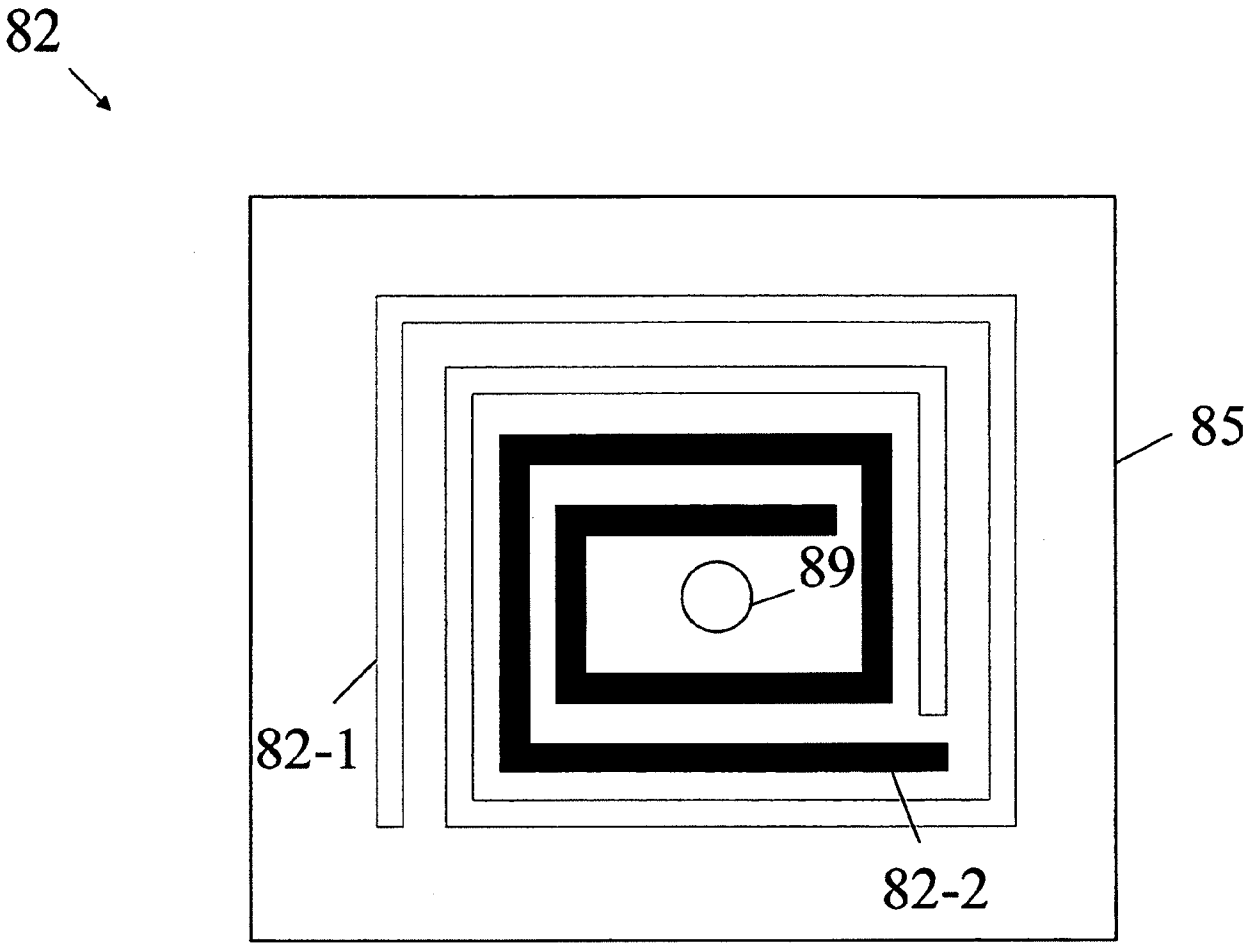
Figure 8C:
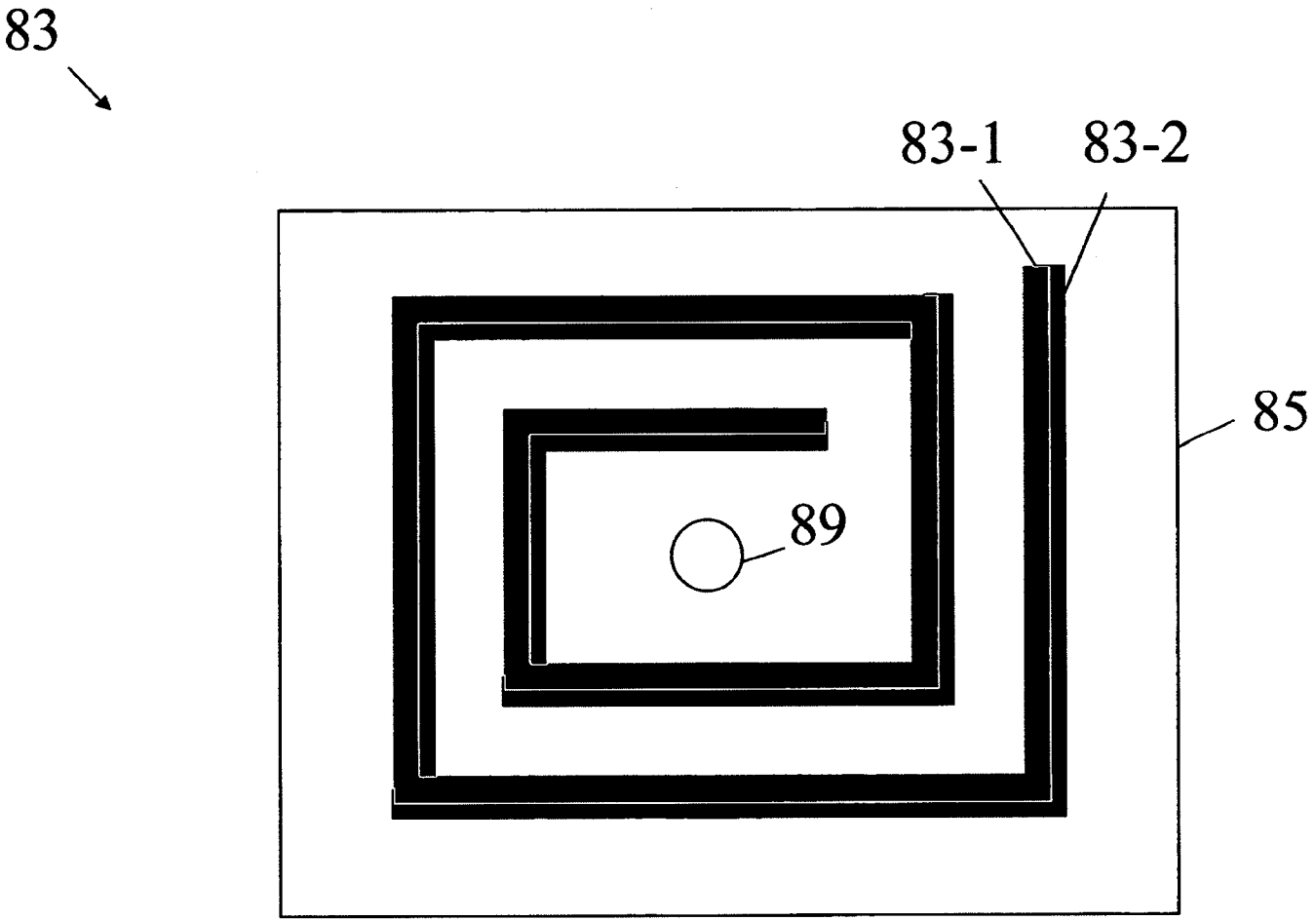

FIGS. 8A, 8B and 8C are schematic diagrams each of an inductor consistent with yet another example of the disclosure. FIG. 8A is a schematic diagram of an inductor 81 formed on a layer 85 of a substrate, which may be a multilayered or laminate substrate. Referring to FIG. 8A, the inductor 81 may include a first coil 81-1 and a second coil 81-2. A hole 89 may be provided at an area on the layer 85 where a magnetic field induced by either the first coil 81-1 or the second coil 81-2 may be relatively intensive. The hole 89 may include a through hole formed through the substrate, a recessed hole formed into the substrate, or a via hole embedded in the substrate. Furthermore, the hole 89 may include a cross-sectional shape having at least one of a slot-like, circular, triangular, rectangular, polygonal and elliptical shape. The first coil 81-1 may serve as a primary winding of a transformer while the second coil 81-2 may serve as a secondary winding of the transformer, and vice versa. In the present example, at least a portion of the first coil 81-1 and at least a portion of the second coil 81-2 may be interleaved with one another.

FIG. 8B is a schematic diagram of an inductor 82. Referring to FIG. 8B, the inductor 82 may be similar to the inductor 81 illustrated in FIG. 8A except a third coil 82-1 and a fourth coil 82-2 may be provided. The third coil 82-1 may serve as a primary winding of a transformer while the fourth coil 82-2 may serve as a secondary winding of the transformer, and vice versa. In the present example, at least a portion of the fourth coil 82-2 may be surrounded by at least a portion of the third coil 82-1.

FIG. 8C is a schematic diagram of an inductor 83. Referring to FIG. 8C, the inductor 83 may include a fifth coil 83-1 formed on the layer 85 and a sixth coil 83-2 formed on a different layer (not shown) of the substrate. The fifth coil 83-1 may serve as a primary winding of a transformer while the sixth coil 83-2 may serve as a secondary winding of the transformer, and vice versa.

In describing representative examples of the disclosure, the specification may have presented the method and/or process of the disclosure as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the disclosure should not be limited to the performance of their steps in the order written, and one skilled in the art can readily appreciate that the sequences may be varied and still remain within the spirit and scope of the disclosure.

It will be appreciated by those skilled in the art that changes could be made to the examples described above without departing from the broad inventive concept thereof It is understood, therefore, that this disclosure is not limited to the particular examples disclosed, but it is intended to cover modifications within the spirit and scope of the disclosure as defined by the appended claims.

That which is claimed:

1. An inductor device comprising:

a substrate comprising a plurality of substrate layers including at least a first substrate layer and a second substrate layer arranged beneath the first substrate layer;

a conductive coil disposed on the first substrate layer and winding around a first area on a surface of the first substrate layer, the conductive coil comprising two terminals and a plurality of conductive windings; and a second area on the surface of the first substrate layer at which at least one hole is provided through the surface of the first substrate layer, the second area being substantially surrounded by at least one of the plurality of conductive windings and the hole being disconnected from the conductive coil.

2. The inductor device of claim 1, further comprising a third area on the surface of the first substrate layer at which a second hole is provided, wherein the third area is spaced apart from the plurality of conductive windings.

3. The inductor device of claim 2, wherein the at least one hole is connected to the second hole forming a coil structure.

4. The inductor device of claim 2, wherein the third area is outside of the plurality of conductive windings on the surface of the first substrate layer.

5. The inductor device of claim 1, wherein a dielectric loss tangent at the second area is smaller than the dielectric loss tangent at other areas on the surface of the first substrate layer.

6. The inductor device of claim 1, wherein the at least one hole has a cross-sectional shape having at least one of a substantially slot-like, circular, triangular, rectangular, polygonal or elliptical shape.

7. The inductor device of claim 1, wherein the at least one hole is filled, plated or coated with a material having a relative permeability greater than approximately 1.1.

8. The inductor device of claim 7, wherein the material comprises any one of iron, cobalt, nickel or copper.

9. The inductor device of claim 1, wherein the at least one hole comprises at least one of a through hole, a via hole or a recessed hole.

10. The inductor device of claim 1, wherein the at least one hole disposed at the second area is configured to induce a relatively intensive magnetic field.

11. The inductor device of claim 1, wherein the at least one hole is a slot hole.

12. The inductor device of claim 2, wherein the second hole is a slot hole.

* * * * *